US012220038B2

(12) United States Patent
Schwarz Borgo et al.

(10) Patent No.: US 12,220,038 B2
(45) Date of Patent: Feb. 11, 2025

(54) REFILLABLE ROLL-ON MATERIAL CONTAINER AND METHOD OF USE THEREOF

(71) Applicant: Braskem S.A., Camaçari (BR)

(72) Inventors: Tarcio Schwarz Borgo, São Paulo (BR); Fabio de Andre Sant'ana, São Paulo (BR)

(73) Assignee: Braskem S.A., Camaçari (BR)

( * ) Notice: Subject to any disclaimer, the term of this patent is extended or adjusted under 35 U.S.C. 154(b) by 0 days.

(21) Appl. No.: 18/298,638

(22) Filed: Apr. 11, 2023

(65) Prior Publication Data

US 2023/0320473 A1 Oct. 12, 2023

Related U.S. Application Data

(60) Provisional application No. 63/329,659, filed on Apr. 11, 2022.

(51) Int. Cl.

| | |
|---|---|
| ***A45D 40/04*** | (2006.01) |
| ***A45D 34/04*** | (2006.01) |
| *A45D 34/00* | (2006.01) |

(52) U.S. Cl.

CPC ..... *A45D 34/041* (2013.01); *A45D 2034/005* (2013.01); *A45D 2200/05* (2013.01); *A45D 2200/10* (2013.01); *A45D 2200/1045* (2013.01)

(58) Field of Classification Search

CPC ..... A45D 34/041; A45D 2034/005; A45D 2200/1045

USPC ..... 401/213

See application file for complete search history.

(56) References Cited

U.S. PATENT DOCUMENTS

| | | | | |
|---|---|---|---|---|
| 10,531,721 | B2 * | 1/2020 | Crawford | B65D 53/06 |
| 2006/0222445 | A1 * | 10/2006 | Chuang | A45D 40/261 401/209 |
| 2016/0157580 | A1 | 6/2016 | Crawford et al. | |

FOREIGN PATENT DOCUMENTS

| | | | | |
|---|---|---|---|---|
| BR | 102019024840 | A2 | 6/2021 | |
| CN | 103906449 | A * | 7/2014 | A45D 34/041 |
| EP | 528265 | A1 * | 2/1993 | A45D 34/041 |
| WO | WO-0070995 | A1 * | 11/2000 | A45D 34/041 |
| WO | WO-2021155454 | A1 * | 8/2021 | A45D 34/041 |

OTHER PUBLICATIONS

International Search Report and Written Opinion issued Jun. 19, 2023, in corresponding International Application No. PCT/IB2023/020026 (49 pages).

* cited by examiner

*Primary Examiner* — Jennifer C Chiang

(74) *Attorney, Agent, or Firm* — Osha Bergman Watanabe & Burton LLP

(57) ABSTRACT

A refillable packaging container for a roll-on material includes a body having a cup at its upper end, a spherical roller ball sitting within and retained by the cup, a refill container configured to contain a roll-on material, and a lid. A method of forming a packaging container includes inserting a refill container configured to contain a roll-on material into a body having a cup at its upper end, a first connection below the cup, and an opening at its lower end, wherein the cup retains a spherical roller ball and retaining the refill container with the body to form the packaging container.

22 Claims, 8 Drawing Sheets

REFILLABLE ROLL-ON MATERIAL CONTAINER AND METHOD OF USE THEREOF

BACKGROUND

Plastics are inexpensive, easy to mold, and lightweight with many commercial applications. Generally, plastics are formed from virgin material, resin produced directly from petrochemical feedstock, such as natural gas or crude oil, which has never been used or processed before. Once the products have outlived their useful lives, they are generally sent to waste disposal such as landfill sites, adding to serious environmental problems, like land, water, and air pollution.

Plastics waste is traditionally disposed of by land fill, incineration, or recycling by reprocessing the waste into raw material for reuse. Unfortunately, while the economic, environmental, and even political demand for products made from recycled plastic exists, the added value created by conventional recycling methods is comparatively low. As a result, large amounts of used plastics can be only partially returned to the economic cycle. Moreover, conventional methods of recycling plastics tend to produce products with lower quality properties.

Even the political landscape impacts the recycling market. When international markets stop investing in domestic recycling streams, waste that would have otherwise gone to foreign recyclers is redirected to domestic landfills. The domestic infrastructure is not equipped to absorb and process the large amount of certain plastics entering in the waste stream, despite the pressure for domestic industries to do so.

Thus, there exists a continuing need to reduce the amount of plastic packaging to reduce the amount of plastic going into landfills.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a refillable packaging container for a roll-on material. The refillable packaging container includes a body, a spherical roller ball, a refill container configured to contain a roll-on material, and a lid.

In another aspect, embodiments disclosed herein relate to method of forming a packaging container. The method includes inserting a refill container configured to contain a roll-on material into a body having a cup at its upper end and retaining the refill container with the body to form the packaging container.

Other aspects and advantages of the claimed subject matter will be apparent from the following description and the appended claims.

DETAILED DESCRIPTION

In one aspect, embodiments disclosed herein relate to a refillable packaging container for a roll-on material. Conventionally, roll-on materials are generally packaged in single use polymer-based material containers. After use, the entire plastic container is usually discarded. However, embodiments disclosed herein relate to a refillable packaging container that provides the user with a choice to use a refill container only, thereby reducing the amount of waste generated and increasing the lifespan of a portion of the packaging, as compared to discarding all packaging and purchasing a new roll-on material packaged product. Thus, a refillable packaging container may reduce the waste generated per unit sold of the roll-on material through its plug and use design.

Embodiments of the present disclosure also relate to a method of assembling and disassembling a refillable packaging container containing a roll-on material. The roll-on material in one or more embodiments may include, for example, deodorant, body lotions, body fragrances, or sunscreen.

Refillable Packaging Container

Generally, one or more embodiments of the refillable packaging container include multiple components including a body, a spherical roller ball, a refill container, and a lid that assemble together to form the refillable packaging container. One or more embodiments may additionally include a rear cap.

Figure 1A:
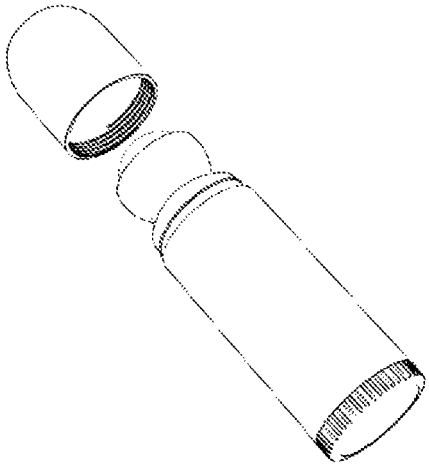
FIG. 1A shows a schematic illustration of a refillable packaging container for a roll-on material according to one or more embodiments of the present disclosure.
Figure 1B:
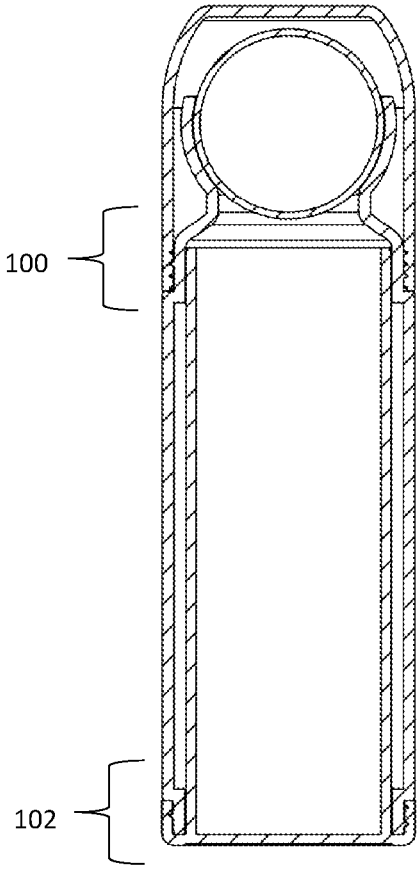
FIG. 1B shows a cross-sectional schematic illustration of the refillable packaging container in FIG. 1A.
Figure 1C:
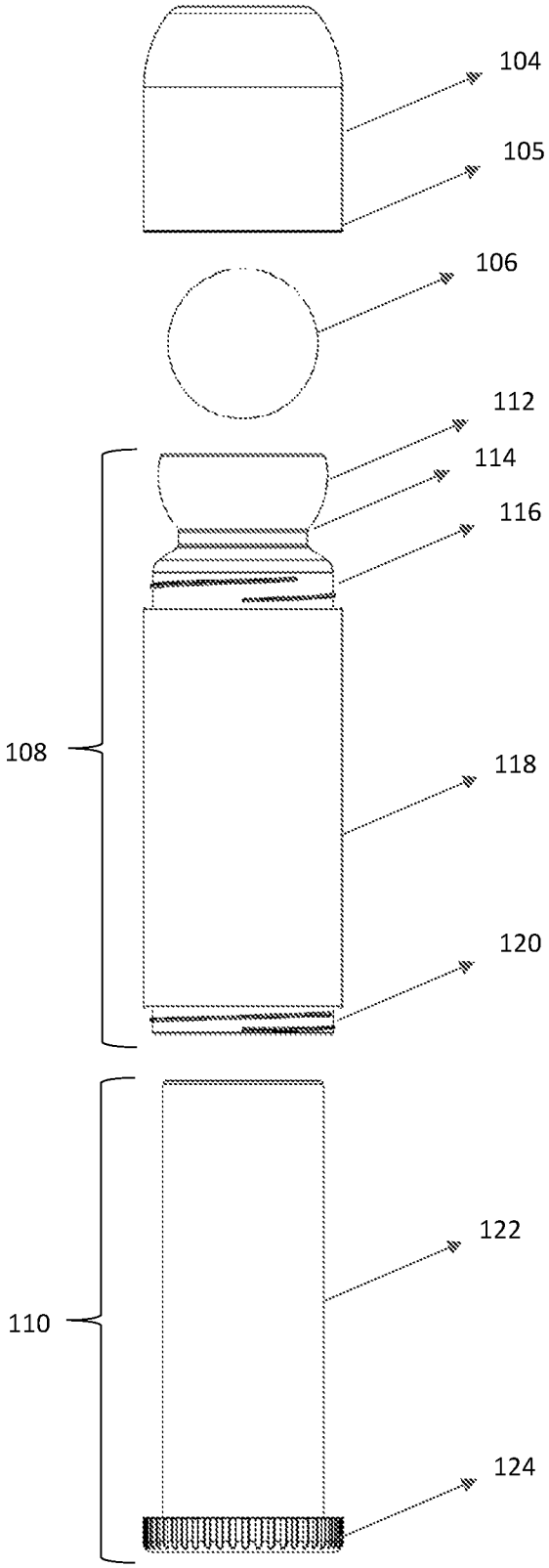
FIG. 1C shows a schematic illustration of the components of the refillable packaging container in FIG. 1A.

FIGS. 1A-1C show one embodiment of a refillable packaging container of the present disclosure. In particular, FIG. 1A shows a perspective view, FIG. 1B shows a cross-sectional view, and FIG. 1C shows an expanded view. The components of the embodiment illustrated in FIGS. 1A-1C include a lid 104, a spherical roller ball 106, a body 108, and a refill container 110. Refill container 110 is configured to contain a roll-on material. Generally, body 108 receives refill container 110 at its lower end and spherical roller ball 106 at its upper end. Spherical roller ball 106 is retained by body 108 in a manner that allows roller ball 106 to rotate or spin freely, such that when refill container 110 is received by body 108, roll-on material contained therein can transfer onto a surface of spherical roller ball 106.

In particular, body 108 has a cup 112 at its upper end having an inner, substantially hemi-spherical concave surface. The cup 112 receives the spherical roller ball 106 that sits within and is retained by the cup 112. As shown, the outer surface of cup 112 is also substantially hemi-spherical (though, the present embodiments are not so limited) and transitions into a neck 114 having a reduced diameter as compared to the mouth of cup 112. Below neck 114, the body 108 widens into first connector 116 onto which lid 104 is secured by way of lid connector 105 on an inside surface of lid 104. As illustrated, connectors 105, 116 are threaded connections (with lid 104 having a female connection and body 108 having a male connection); however, it is also envisioned that other types of connections may be used to secure lid 104 on body 108 when the product is not being used by a consumer.

Below connector 116 (as a part of body 108) is a substantially cylindrical main section 118. At a lower end of body 108 (below main section 118) is a second connector 120. Body 108 is open or hollow at its lower end such that the refill container 110 is inserted into the body 108. The refill container 110 includes a refill container cylindrical body part 122 forming the substantial majority of refill container and a refill connector 124 at the lower end. As illustrated, the second connector 120 and the refill connector 124 are threaded connections (with refill container 110 having a female connection and body 108 having a male connection); however, it is also envisioned that other types of connections may be used to secure refill container 110 within body 108 when the refill container 110 is not being exchanged by a consumer. The refill container 110 includes a flat lower end 120. The refill container 110 is configured to contain a roll-on material that is inserted into the body 108 at the lower end 120 and is detachably retained within the body 108. As illustrated, the refill container 110 is connected to the body 108 by threading the lower end of the body 120 to the lower end 124 of the refill container. Thus, when refill container 110 is retained within body 10, the roll-on material contained therein may transfer onto the spherical roller ball and then be applied to desired surface.

The cross-sectional view shows that the design of FIG. 1A may include a dual sealing barrier to prevent from spilling of the roll-on material. The first barrier 100 is formed between the inner surface of body 108 and the outer surface of refill container 110 (near the roll on ball) and the second barrier 102 is at the connection between body 108 and refill container 110.

Figure 2A:
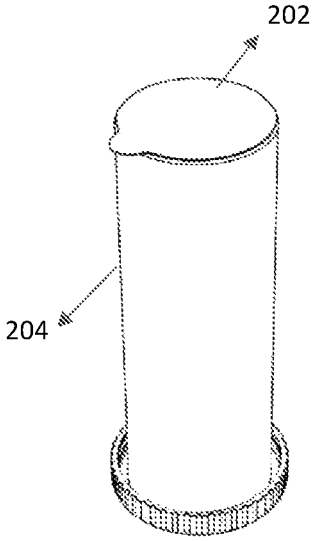
FIG. 2A shows a schematic illustration of a refill container according to one or more embodiments of the present disclosure.
Figure 2B:
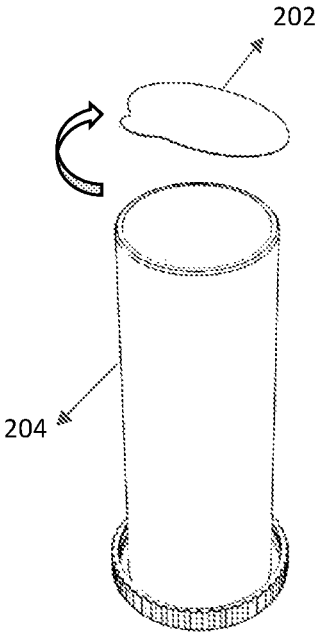
FIG. 2B shows a schematic illustration of a step in the assembly of a refillable packaging container according to one or more embodiments of the present disclosure.
Figure 2C:
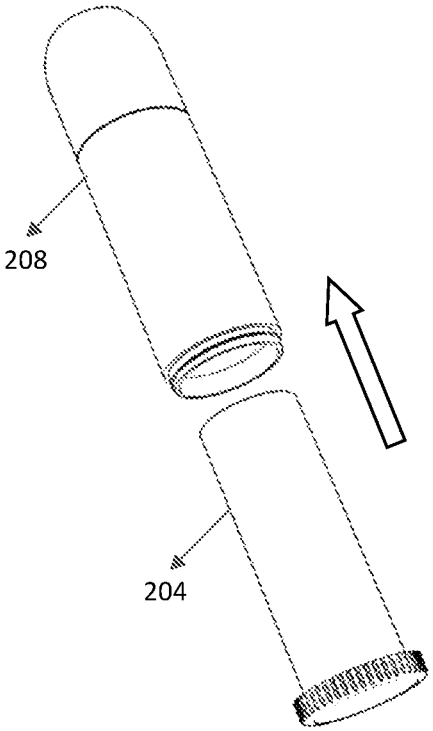
FIG. 2C shows a schematic illustration of a step in the assembly of a refillable packaging container according to one or more embodiments of the present disclosure.
Figure 2D:
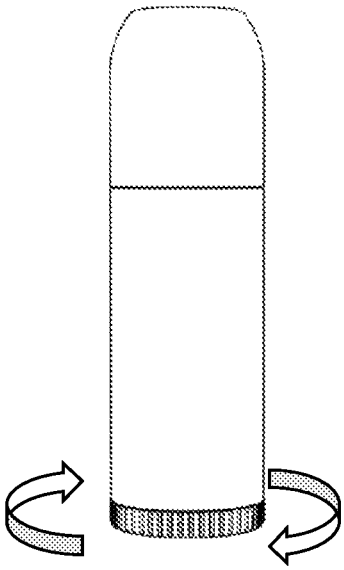
FIG. 2D shows a schematic illustration of a step in the assembly of a refillable packaging container according to one or more embodiments of the present disclosure.

FIGS. 2A-2D show the steps in assembling the refill of FIG. 1A. The method may include inserting a refill container configured to contain a roll-on material into a body having a cup at its upper end, a first connection below the cup, and an opening at its lower end; retaining the refill container with the body to form the refillable packaging container; and optionally replacing the refill container with a new refill container. FIG. 2A shows a refill container, prior to assembly. The refill container 204 may contain a sealing film 202. The refill container 204 may be sealed with a film 202, which may be produced from plastic or any other suitable material. First, the film 202 is peeled off as shown in FIG. 2B. Next, the refill container 204 is inserted into the body 208 as shown in FIG. 2C. The arrow in FIG. 2C shows the direction in which the refill container 204 is inserted into the body 208. Lastly, the refill container 204 is locked into the body 208 as shown in FIG. 2D. As illustrated, the refill container 204 is screwed onto body 208; however, if other types of connections are used, then it is understood that the appropriate action may differ.

Figure 3A:
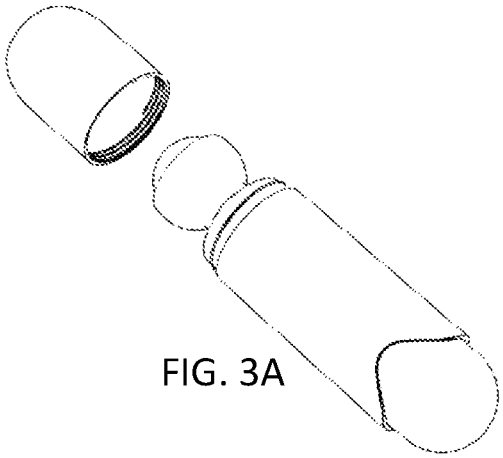
FIG. 3A shows a schematic illustration of a refillable packaging container for a roll-on material according to one or more embodiments of the present disclosure.
Figure 3B:
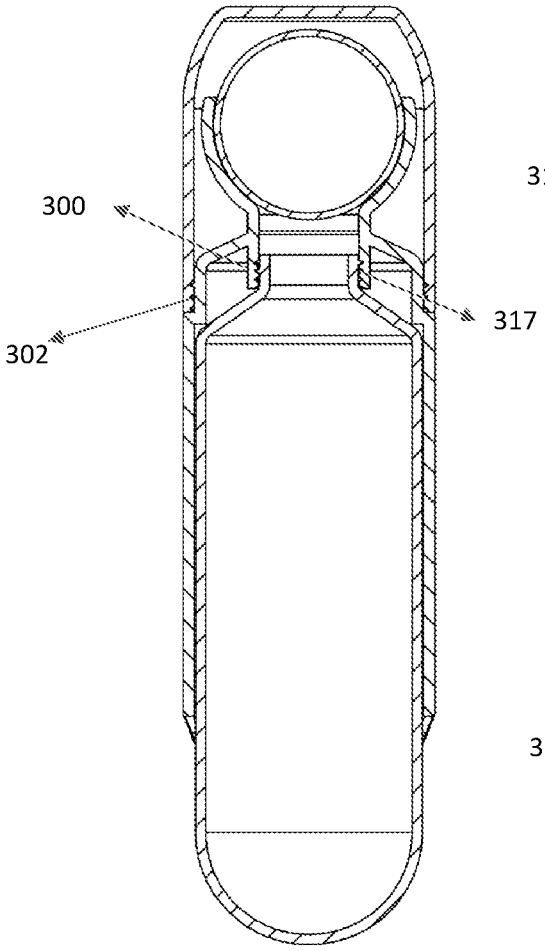
FIG. 3B shows a cross-sectional schematic illustration of the refillable packaging container in FIG. 3A.
Figure 3C:
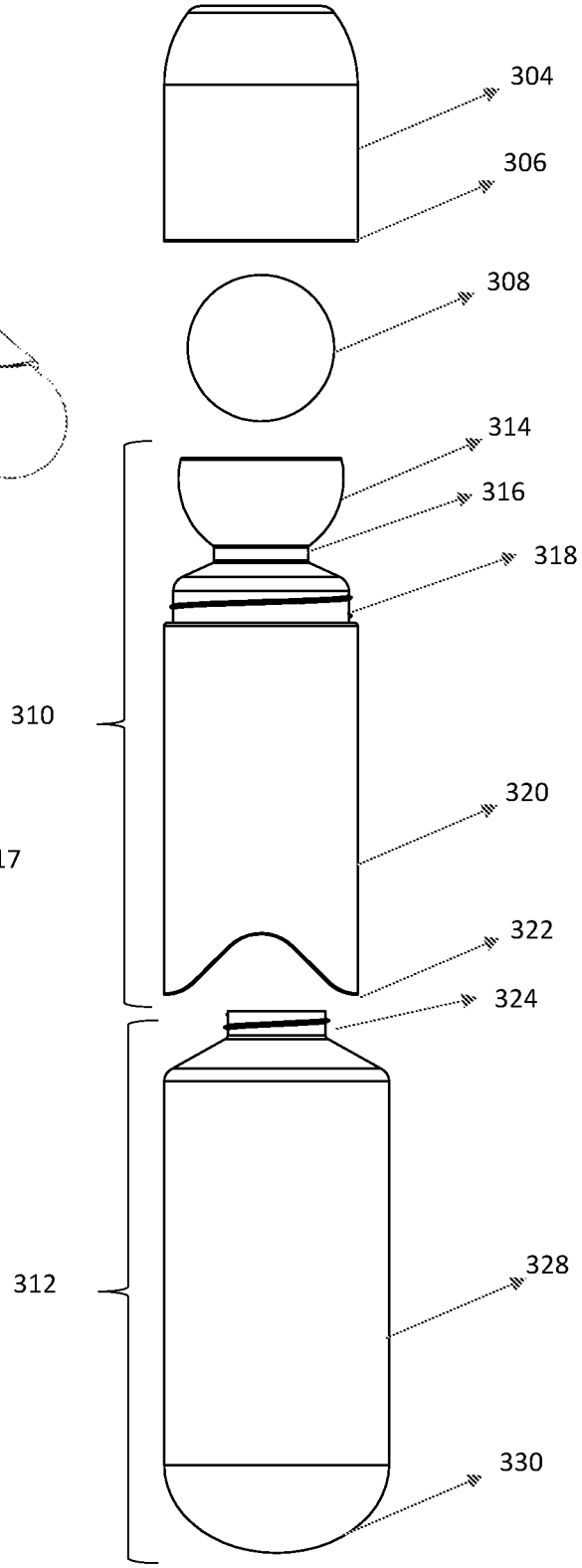
FIG. 3C shows a schematic illustration of the components of the refillable packaging container in FIG. 3A.

FIGS. 3A-3C show one embodiment of a refillable packaging container of the present disclosure. In particular, FIG. 3A shows a perspective view, FIG. 3B shows a cross-sectional view, and FIG. 3C shows an expanded view. The components of the embodiment illustrated in FIGS. 3A-3C include a lid 304, a spherical roller ball 308, a body 310, and a refill container 312. Refill container 312 is configured to contain a roll-on material. Generally, body 310 receives refill container 312 at its lower end and spherical roller ball 308 at its upper end. Spherical roller ball 308 is retained by body 310 in a manner that allows roller ball 308 to rotate or spin freely, such that when refill container 312 is received by body 310, roll-on material contained therein can transfer onto a surface of spherical roller ball 308.

In particular, body 310 has a cup 314 at its upper end having an inner, substantially hemi-spherical concave surface. The cup 314 receives the spherical roller ball 308 that sits within and is retained by the cup 314. As shown, the outer surface of cup 314 is also substantially hemi-spherical (though, the present embodiments are not so limited) and transitions into a neck 316 having a reduced diameter as compared to the mouth of cup 314. Below neck 316, the body 310 widens into first connector 318 onto which lid 304 is secured by way of lid connector 306 on an inside surface of lid 304. As illustrated, connectors 306, 318 are threaded connections (with lid 304 having a female connection and body 310 having a male connection); however, it is also envisioned that other types of connections may be used to secure lid 304 on body 310 when the product is not being used by a consumer.

Returning to the external features of body 310, below connector 318 is a substantially cylindrical main section 320. The lower end 322 of body 310 (below main section 320) is open or hollow such that the refill container 312 is inserted into the body 310. Unlike the embodiment illustrated in FIG. 1A-1C, body 310 does not include a connector at a lower end thereof. Rather, an upper end of the body 310 includes a second connector 317 (shown in FIG. 3B) on an inner surface (within the inside of body 310) that extends downward from the neck 316 while the exterior surface of body 310 widens to first connector 318. The refill container 312 includes a refill container cylindrical body part 328 forming the substantial majority of refill container and a refill connector 324 at the upper end. As illustrated, the refill connector 324 has threaded connections (a male connection). The refill connector 324 is threaded to body's second connector 318 having a female connection; however, it is also envisioned that other types of connections may be used to secure refill container 312 within body 310 when the refill container 312 is not being exchanged by a consumer. The refill container 312 includes a substantially hemi-spherical convex lower end 330. The refill container 312 is configured to contain a roll-on material that is inserted into the body 310 at the lower end 322 and is detachably retained within the body 310. As illustrated, the refill container 312 is connected to the body 310 by threading the second connector 317 in the upper end of the body 310 to the upper end 324 of the refill container 312. Thus, when refill container 312 is retained within body 320, the roll-on material contained therein may transfer onto the spherical roller ball and then be applied to desired surface.

The cross-sectional view in FIG. 3B shows that the design of FIG. 3A may include a dual sealing barrier to prevent from spilling of the roll-on material. The first barrier 300 is formed at the connection between body 310 and refill container 110 (near the roll on ball) and the second barrier 302 is at the connection between body 310 and the lid 304.

Figure 4A:
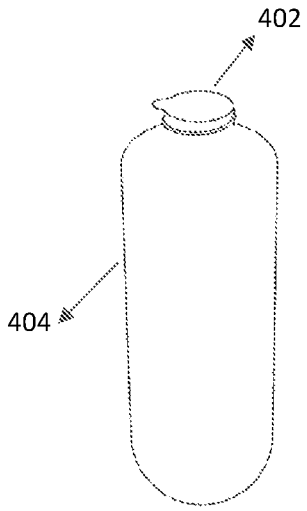
FIG. 4A shows a schematic illustration of a refill container according to one or more embodiments of the present disclosure.
Figure 4B:
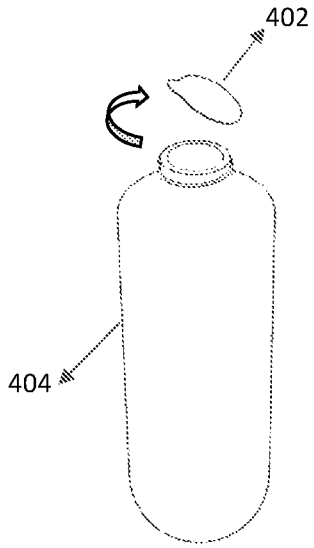
FIG. 4B shows a schematic illustration of a step in the assembly of a refillable packaging container according to one or more embodiments of the present disclosure.
Figure 4C:
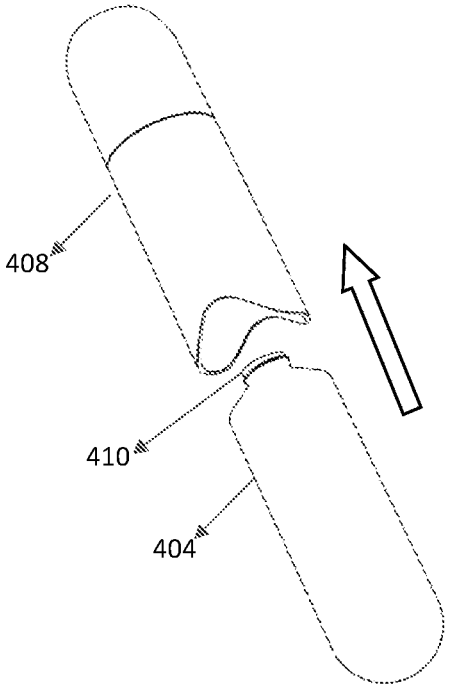
FIG. 4C shows a schematic illustration of a step in the assembly of a refillable packaging container according to one or more embodiments of the present disclosure.
Figure 4D:
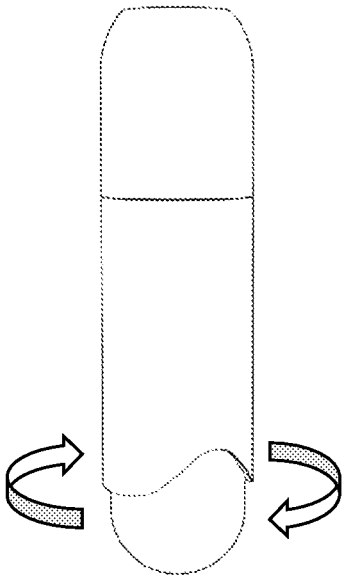
FIG. 4D shows a schematic illustration of a step in the assembly of a refillable packaging container according to one or more embodiments of the present disclosure.

FIGS. 4A-4D show the steps in assembling the refill of FIG. 3A. The method may include inserting a refill container configured to contain a roll-on material into a body having a cup at its upper end, a first connection below the cup, and an opening at its lower end; retaining the refill container with the body to form the refillable packaging container; and optionally replacing the refill container with a new refill container. FIG. 4A shows a refill container 404, prior to assembly. The refill container 404 contains a sealing film 402. The refill container 404 may be sealed with a film 402, which may be produced from plastic or any other suitable material. First, the film 402 is peeled off as shown by the arrow in FIG. 4B. Next, the refill container 404 is inserted into the body 408 as shown by in FIG. 4C. The arrow in FIG. 4C shows the direction in which the refill container 404 is inserted into the body 408. Lastly, the refill container 404 is locked into the body 408 as shown by the arrows in FIG. 4D. The refill container 404 is attached to the body 408 by threating the upper end 410 of the refill container 404 to the upper end of the body 408. As illustrated, the refill container 404 is screwed onto body 408; however, if other types of connections are used, then it is understood that the appropriate action may differ.

Figure 5A:
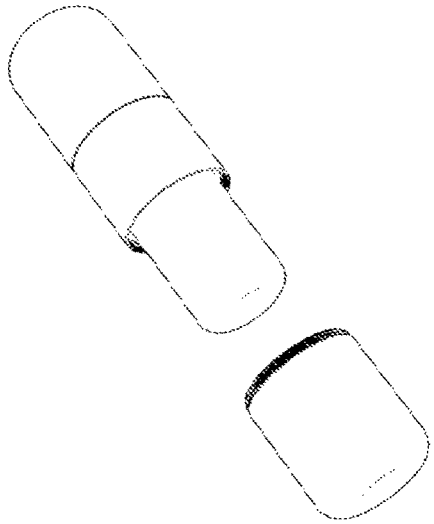
FIG. 5A shows a schematic illustration of a refillable packaging container for a roll-on material according to one or more embodiments of the present disclosure.
Figure 5B:
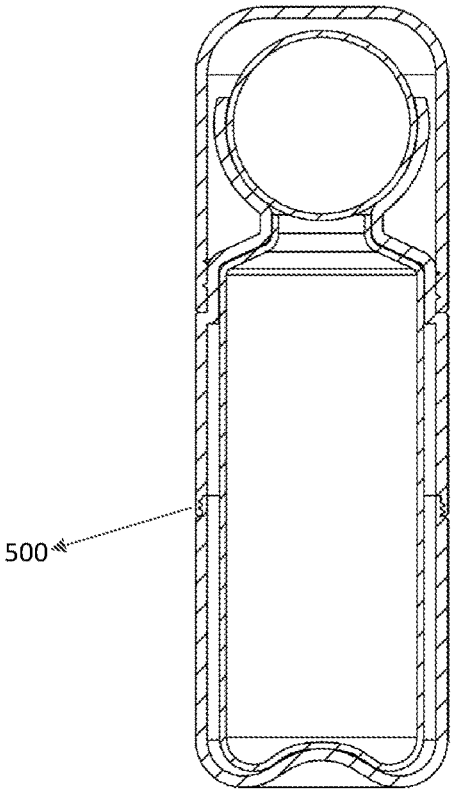
FIG. 5B shows a cross-sectional schematic illustration of the refillable packaging container in FIG. 5A.
Figure 5C:
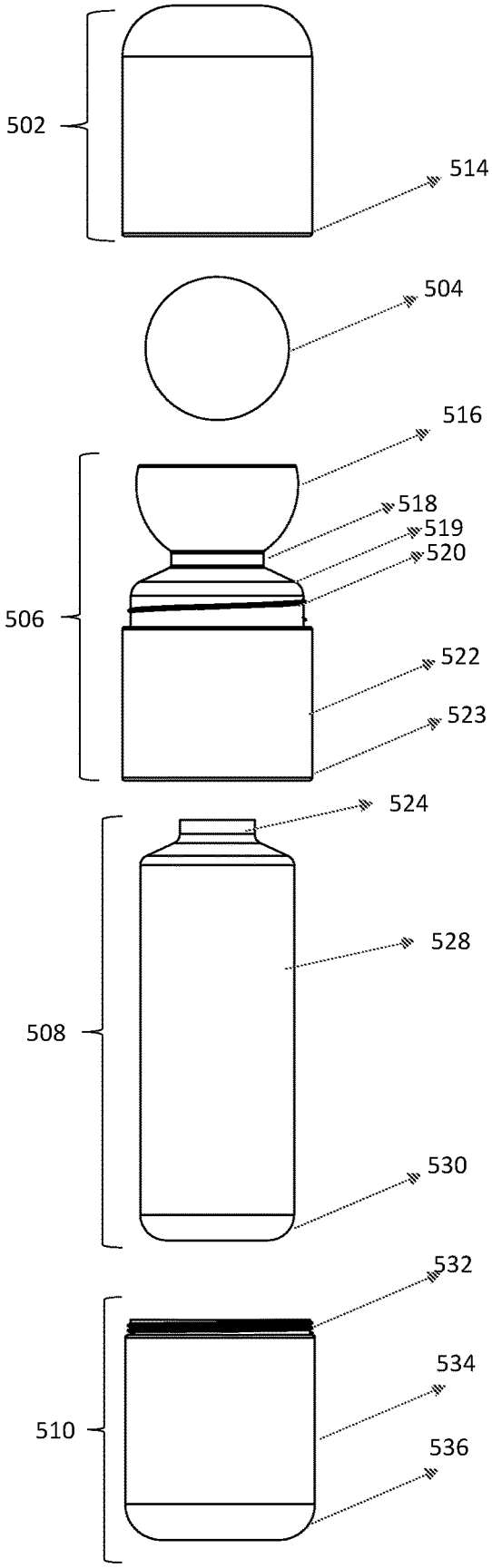
FIG. 5C shows a schematic illustration of the components of the refillable packaging container in FIG. 5A.

FIGS. 5A-5C show another embodiment of a refillable packaging container of the present disclosure. In particular, FIG. 5A shows a perspective view, FIG. 5B shows a cross-sectional view, and FIG. 5C shows an expanded view. The components of the embodiment illustrated in FIGS. 5A-5C include a lid 502, a spherical roller ball 504, a body 506, a refill container 508, and a rear cap 510. Refill container 508 is configured to contain a roll-on material. Generally, body 506 receives refill container 508 at its lower end and spherical roller ball 504 at its upper end. Spherical roller ball 504 is retained by body 506 in a manner that allows roller ball 504 to rotate or spin freely, such that when refill container 508 is received by body 506, roll-on material contained therein can transfer onto a surface of spherical roller ball 504. The refill container 508 is further secured into the body 506 by a rear cap 510.

In particular, body 506 has a cup 516 at its upper end having an inner, substantially hemi-spherical concave surface. The cup 516 receives the spherical roller ball 504 that sits within and is retained by the cup 516. As shown, the outer surface of cup 516 is also substantially hemi-spherical (though, the present embodiments are not so limited) and transitions into a neck 518 having a reduced diameter as compared to the mouth of cup 516 Below neck 518, the body 506 widens into first connector 520 onto which lid 502 is secured by way of lid connector 514 on an inside surface of lid 502. As illustrated, connectors 514, 520 are threaded connections (with lid 502 having a female connection and body 506 having a male connection); however, it is also envisioned that other types of connections may be used to secure lid 502 on body 506 when the product is not being used by a consumer. As illustrated, the refill container 508 is connected to the body 506 by connecting the upper end 524 of the refill container 508 to a second connector 519 in the upper end of the body 506. The refill container 508 is inserted and attached onto the body 506. The refill container 508 includes a refill container cylindrical body part 528 forming the substantial majority of refill container and a hemi-spherical curved surface at the lower end 530. Below connector 518 is a substantially cylindrical main section 522. At a lower end of body 506 (below main section 522) is a third connector 523 (on an inner surface of body 506).

The rear cap 510 is connected to the body 506 by connecting the third connector 523 in the lower end of the body 506 to the rear cap connector 532 at the upper end of the read cap 510 (with body 506 having a female connection and rear cap 510 having a male connection); however, it is also envisioned that other types of connections may be used to secure refill container 508 within body 506 and rear cap 510 when the refill container 508 is not being exchanged by a consumer. Below rear cap connector 532 is a substantially cylindrical portion 534 with and an arcuate transition to the lower end 536.

The cross-sectional view shows that the design of FIG. 5A may include a single sealing barrier to prevent from spilling of the roll-on material. The barrier 500 is formed between the inner surface of body 506 and the outer surface of the rear cap 510.

Figure 6A:
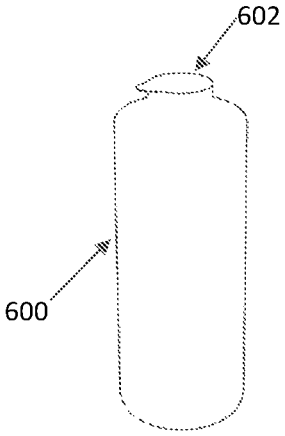
FIG. 6A shows a schematic illustration of a refill container according to one or more embodiments of the present disclosure.
Figure 6B:
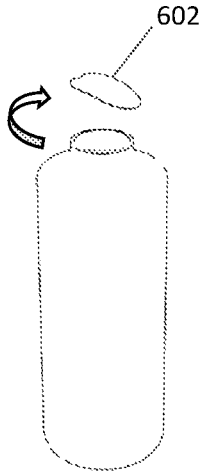
FIG. 6B shows a schematic illustration of a step in the assembly of a refillable packaging container according to one or more embodiments of the present disclosure.
Figure 6C:
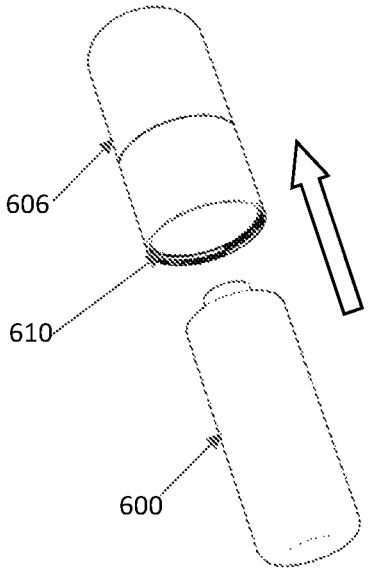
FIG. 6C shows a schematic illustration of a step in the assembly of a refillable packaging container according to one or more embodiments of the present disclosure.
Figure 6D:
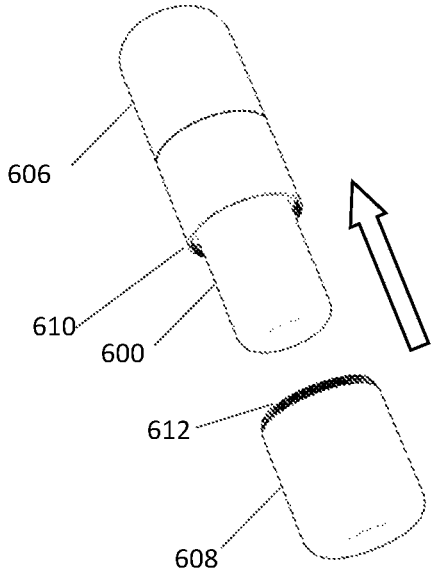
FIG. 6D shows a schematic illustration of a step in the assembly of a refillable packaging container according to one or more embodiments of the present disclosure.
Figure 6E:
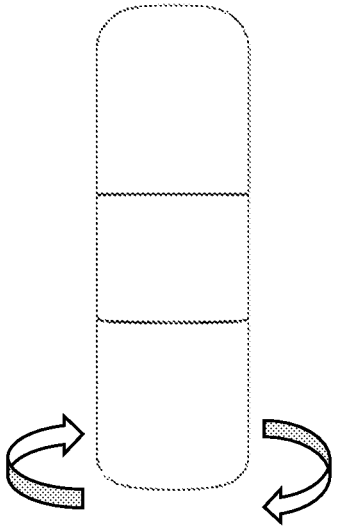
FIG. 6E shows a schematic illustration of a step in the assembly of a refillable packaging container according to one or more embodiments of the present disclosure.

FIGS. 6A-6E illustrates the steps in assembling the refill of FIG. 5A. The method may include inserting a refill container configured to contain a roll-on material into a body having a cup at its upper end, a first connection below the cup, and an opening at its lower end; retaining the refill container with the body to form the refillable packaging container; and locking the refill container by threading the upper end of a rear car to the lower end of the body. FIG. 6A shows a refill container 600, prior to assembly. The refill container 600 contains a sealing film 602. The refill container 600 is sealed with a film 602, which may be produced from plastic or any other suitable material. First, the film 602 is peeled off as shown by the arrow in FIG. 6B. Next, the refill container 600 is inserted into the body 606 as shown by in FIG. 6C. The arrow in FIG. 6C shows the direction in which the refill container 600 is inserted into the body 606. After the insertion of the refill container 600 into the body, the rear cap 608 is attached to the body by threading the lower end 610 of the body 606 to the upper end 612 of the rear cap 608 as shown by the arrow FIG. 6D. Lastly, the rear cap 608 is locked into the body 606 as shown by the arrows in FIG. 6E. The refill container 600 is attached to the body 606 by threating the upper end 612 of the rear cap 608 to the lower end 610 of the body 606.

Figure 7A:
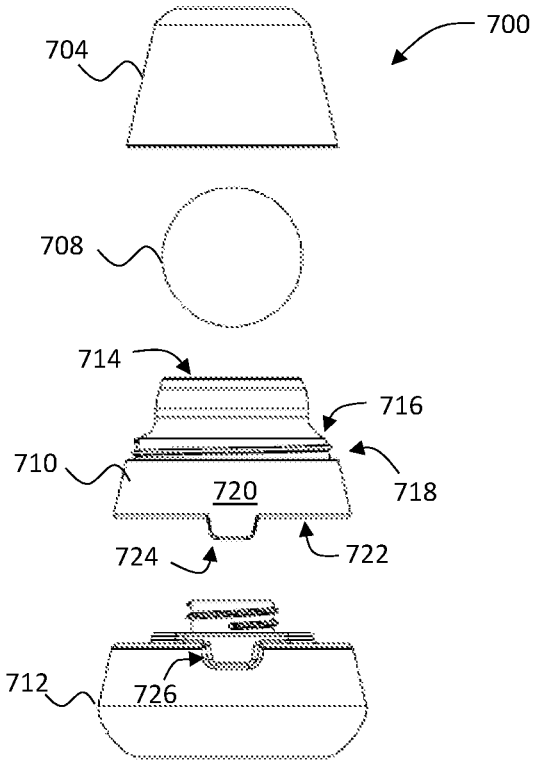
FIG. 7A shows an expanded view of a refillable packaging container for a roll-on material according to one or more embodiments of the present disclosure.
Figure 7B:
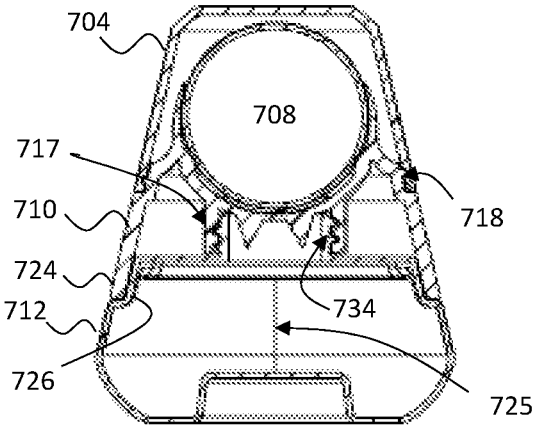
FIG. 7B provides a cross-sectional view of a refillable packaging container for a roll-on material according to one or more embodiments of the present disclosure FIG. 7C provides a cross-sectional view of body of a refillable packaging container for a roll-on material according to one or more embodiments of the present disclosure.
Figure 7C:
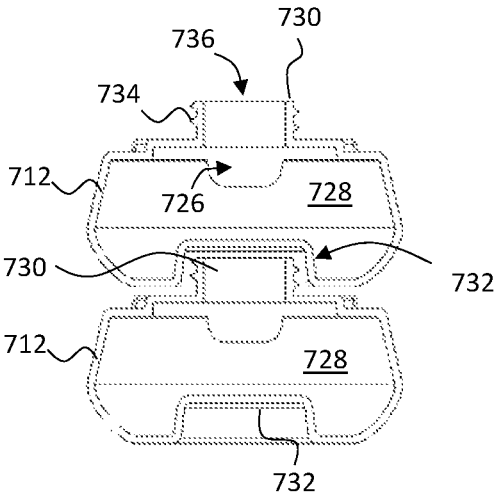
FIG. 7D shows a bottom perspective view of a body according to one or more embodiments of the present disclosure.
Figure 7D:
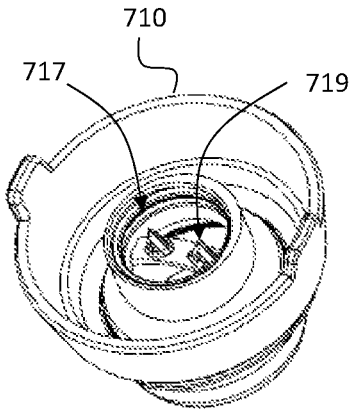
Figure 8A:
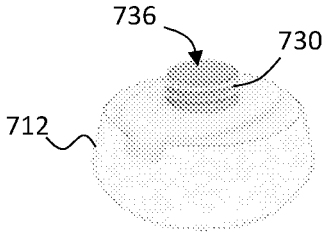
FIG. 8A shows a schematic illustration of a refill container according to one or more embodiments of the present disclosure.
Figure 8B:
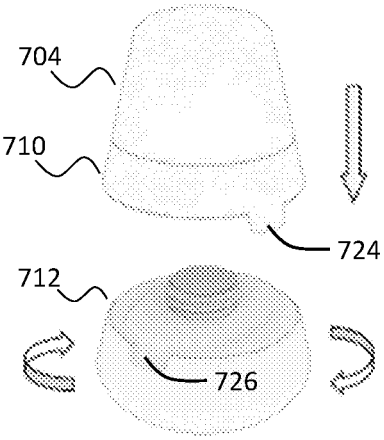
FIG. 8B shows a schematic illustration of a step in the assembly of a refillable packaging container according to one or more embodiments of the present disclosure.
Figure 8C:
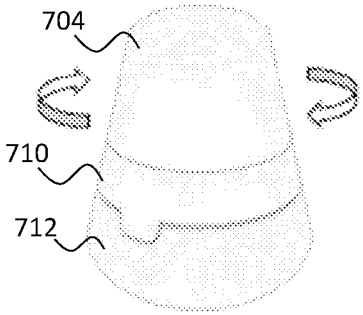
FIG. 8C shows a schematic illustration of a step in the assembly of a refillable packaging container according to one or more embodiments of the present disclosure.
Figure 8D:
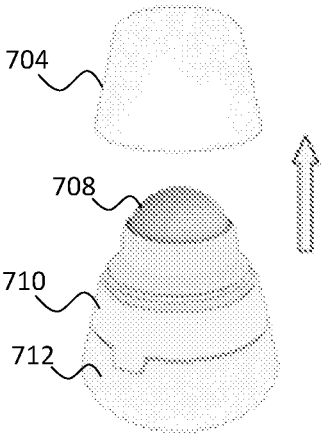
FIG. 8D shows a schematic illustration of a step in the assembly of a refillable packaging container according to one or more embodiments of the present disclosure.

Referring to FIG. 7A-7D, another embodiment of a refillable packaging container of the present disclosure is shown. The components of the refillable packaging container 700 illustrated in FIG. 7A-7D include a lid 704, a spherical roller ball 708, a body 710, and a refill container 712. FIG. 7A shows an expanded view of the four components, FIG. 7B provides a cross-sectional view of the four components body 710, FIG. 7C provides a cross-sectional view of the body 710, and FIG. 7D shows a bottom perspective view of body 710.

Refill container 712 is configured to contain a roll-on material. Generally, body 710 receives refill container 712 at its lower end and spherical roller ball 708 at its upper end. Spherical roller ball 708 is retained by body 710 in a manner that allows roller ball 708 to rotate or spin freely, such that when refill container 712 is received by body 710, roll-on material contained therein can transfer onto a surface of spherical roller ball 708.

In particular, body 710 has a cup 714 at its upper end similar as described in the aforementioned embodiments. The cup 714 receives the spherical roller ball 708 that sits within and is retained by the cup 714. As shown, the outer surface of cup 714 has a substantially constant diameter (though, the present embodiments are not so limited) and transitions into a shoulder 716 having a increased diameter as compared to the mouth of cup 714. At shoulder 716, the body includes first connector 718 onto which lid 704 is secured.

Returning to the external features of body 710, below connector 718 is main section 720. As shown, main section 720 has widens to lower end 722 of body 710 which is open or hollow such that the refill container 712 is inserted into the body 710. The refill container 712 includes a refill container body part 728 forming the substantial majority of refill container and a refill connector 734 adjacent cup 714 on an inner surface of refill container (shown in FIG. 7C). As illustrated, the refill connector 734 has threaded connections (a male connection). An upper end of the body 710 includes a second connector 717 (shown in FIG. 7D) on an inner surface (within the inside of body 710) that extends downward from the shoulder 716 while the exterior surface of body 710 widens to first connector 718. The refill connector 734 is threaded to body's second connector 717 having a female connection; however, it is also envisioned that other types of connections may be used to secure refill container 712 within body 710 when the refill container 712 is not being exchanged by a consumer.

Moreover, as best illustrated in FIGS. 7A and 7B, in addition to a threaded connection, a latching mechanism is also provided between body 710 and refill container 712. Specifically, lower end 722 of body 710 includes latches 724 that fit within grooves 726 in refill container. Latches 724 and grooves 726 secure refill container 712 to body 710. Refill container 712 can be released from body 710 by a squeeze-and-turn operation, whereby squeezing body 710 between latches 724 at region 725 releases latches from grooves 726, so that body 712 and refill container 712 may be rotated with respect to one another, thereby allowing for refill container 712 to be removed from body 710. When refill container 712 is retained within body 710, the roll-on material contained therein may transfer onto the spherical roller ball and then be applied to desired surface.

The refill container 712 includes a refill container body part 728 forming the substantial majority of refill container and a refill neck 730 at the upper end. While the embodiments provided above all generally show a refill container having a longer length relative to diameter, refill container 712 has a larger diameter relative to length.

The refill container 712 contains a sealing film (not shown). While in some embodiments such sealing film may be removed prior connecting refill container 712 to body 710, it is also envisioned that body may include, adjacent second connector 717 piercing extensions 719 that will pierce sealing film when the refill container 712 is loaded within body 710, as shown in FIG. 7D.

As shown in FIG. 7C, the refill container 712 includes a concavity 732 at a lower surface thereof. When one refill container 712 is stacked upon another, the refill neck 730 of one container 712 fits within the concavity 732 of the one being stacked thereon. The refill container 712 is configured to contain a roll-on material that is inserted into the body 710 at the lower end 722 and is detachably retained within the body 710.

Moreover, it is specifically noted that any of the features illustrated in the aforementioned figures, such as, but not limited to the latching mechanism, the cavity, the piercing elements, the sealing components, etc., may be used in the other illustrated embodiments.

In operation, as illustrated in FIGS. 8A-8D to insert a new refill container 712, a body 710 is lowered onto refill container 712, and the two are rotated with respect to one another. This rotation allows for body 710 to be threaded onto refill container 712, and such connection is secured by latches 724 extended from body 710 that fit within grooves 726 in refill container 712. If the refill container contains a sealing film at the mouth 736 of refill neck 730, piercing extensions (719 in FIG. 7D) will pierce sealing film when the refill container 712 is attached to body 710. As also shown, lid 704 is be removed from body 710 to reveal ball 708. The roll-on material contained within refill container 712 may transfer onto the spherical roller ball 708 and then be applied to desired surface.

The body and the lid described in the above embodiments in accordance with the present disclosure may be made, for example from a polyethylene, a polypropylene, an acrylonitrile butadiene (ABS), a polycarbonate (PC), a polyamide (PA), or combinations thereof. Particularly suitable polyethylene is high-density polyethylene. The refill container described in the above embodiments in accordance with the present disclosure may be made from polyethylene, such as high-density polyethylene, polypropylene, polyethylene terephthalate, or combinations thereof. The spherical roller ball and rear cap in accordance with the present disclosure may be formed from polyethylene, such as high-density polyethylene, or polypropylene. It is envisioned that each component may be formed of a monomaterial, thereby allowing the discrete components to be more readily recyclable than a multi-material component. Moreover, it is also envisioned that all the components may be formed from the same material, such as polypropylene or polyethylene, thereby allowing the whole structure to be readily recyclable. In other embodiments, a combination of discrete components with different materials may also be considered.

In one or more embodiments, the components may be made from virgin or recycled resins. The recycled resin may comprise one or more selected from a post-consumer resin (PCR) and a post-industrial resin (PIR), including regrind, scraps and defective articles. PCR refers to resins that are recycled after consumer use, whereas PIR refers to resins that are recycled from industrial materials and/or processes (for example, cuttings of materials used in making other articles).

In one or more embodiments, the components may be made from biobased or petrochemical material. "Biobased material" in the present disclose refers to as natural sources from which a renewable source of carbon is derived for polymers and monomers used to produce the biobased polymer compositions.

Biobased ethylene polymers and monomers that are derived from natural products may be distinguished from polymers and monomers obtained from fossil-fuel sources (also referred to as petrochemical-based polymers). Because biobased materials are obtained from sources that actively reduce $CO_2$ in the atmosphere or otherwise require less $CO_2$ emission during production, such materials are often regarded as "green" or renewable. The use of products derived from natural sources, as opposed to those obtained from fossil sources, has increasingly been widely preferred as an effective means of reducing the increase in atmospheric carbon dioxide concentration, therefore effectively limiting the expansion of the greenhouse effect. Products thus obtained from natural raw materials have a difference, relative to fossil sourced products, in their renewable carbon contents. This renewable carbon content can be certified by the methodology described in the technical ASTM D 6866-18 Norm, "Standard Test Methods for Determining the Biobased Content of Solid, Liquid, and Gaseous Samples Using Radiocarbon Analysis". Products obtained from renewable natural raw materials have the additional property of being able to be incinerated at the end of their life cycle and only producing $CO_2$ of a non-fossil origin.

Examples of biobased polymer composition may include polymers generated from ethylene derived from natural sources such as sugarcane and sugar beet, maple, date palm, sugar palm, sorghum, American agave, starches, corn, wheat, barley, sorghum, rice, potato, cassava, sweet potato, algae, fruit, citrus fruit, materials comprising cellulose, wine, materials comprising hemicelluloses, materials comprising lignin, cellulosics, lignocelluosics, wood, woody plants, straw, sugarcane bagasse, sugarcane leaves, corn stover, wood residues, paper, polysaccharides such as pectin, chitin, levan, pullulan, and the like, and any combination thereof.

Biobased materials may be processed by any suitable method to produce ethylene, such as the production of ethanol from sugarcane, and the subsequent dehydration of ethanol to ethylene. Further, it is also understood that the fermenting produces, in addition to the ethanol, byproducts of higher alcohols. If the higher alcohol byproducts are present during the dehydration, then higher alkene impurities may be formed alongside the ethanol. Thus, in one or more embodiments, the ethanol may be purified prior to dehydration to remove the higher alcohol byproducts while in other embodiments, the ethylene may be purified to remove the higher alkene impurities after dehydration.

Biologically sourced ethanol, known as bio-ethanol, used to produce ethylene may be obtained by the fermentation of sugars derived from cultures such as that of sugar cane and beets, or from hydrolyzed starch, which is, in turn, associated with other materials such as corn. It is also envisioned that the biobased ethylene may be obtained from hydrolysis-based products from cellulose and hemi-cellulose, which can be found in many agricultural by-products, such as straw and sugar cane husks. This fermentation is carried out in the presence of varied microorganisms, the most important of such being the yeast *Saccharomyces cerevisiae*. The ethanol resulting therefrom may be converted into ethylene by means of a catalytic reaction at temperatures usually above 300° C. A large variety of catalysts can be used for this purpose, such as high specific surface area gamma-alumina.

In one or more embodiments, biobased products obtained from natural materials may be certified as to their renewable carbon content, according to the methodology described in the technical standard ASTM D 6866-18, "Standard Test Methods for Determining the Biobased Content of Solid, Liquid, and Gaseous Samples Using Radiocarbon Analysis."

Biobased resins in accordance with the present disclosure may include an ethylene-containing resin having biobased carbon content as determined by ASTM D6866-18 Method B of at least 5%, or having a lower limit of any of 5%, 10%, 15%, 25%, 40% and 50% and an upper limit selected from any of 60%, 75%, 90%, 98%, and 100%, where any lower limit may be combined with any upper limit. Further, it is also noted that another polymer derived from renewable sources which may be used in one of more embodiments is polylactic acid, which in addition to being formed from renewable sources is also compostable.

The lid, body, refillable container, spherical roller ball, and the rear cap may be prepared by any available plastic transformation process. In one or more embodiments, the lid, body, refillable container, spherical roller ball, and/or the rear cap may be made by a plastic transformation process selected from a group consisting of injection molding, blow molding, thermoforming and combinations thereof. In particular embodiments, the lid, body, refillable container, spherical roller ball, and/or the rear cap may be made by injection molding. In one or more embodiments, the refillable container may be made by blow molding. In one or more embodiments, the lid may be made by thermoforming.

In one or more embodiments, the new refill container may have a different volume than the refill container it is replacing. Such differences in volume may, for example, be achieved by varying either the length or diameter of the replacement refill container. For example, the embodiments illustrated in FIGS. 1 and 5 may have a refill container of smaller diameter in the cylindrical main section, thereby reducing the volume of the refill container. The embodiment illustrated in FIG. 3 may have a refill container that has varying length of the cylindrical main section, thereby changing the volume of the refill container.

Embodiments of the present disclosure are easy to assemble and disassemble. The ease of disassembly may make the refillable packaging container easier to recycle. The threading of the parts in the embodiments of the present disclosure may ensure a sealed and non-spill system.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A refillable packaging container for a roll-on material, comprising:

a body having a cup at its upper end, a first connection below the cup, and an opening at its lower end;

a spherical roller ball sitting within and retained by the cup;

a refill container configured to contain a roll-on material and that is inserted into the body at the lower end and is detachably retained within the body; and a lid, that fastens onto the first connection, wherein the body and refill container comprise a latching mechanism, the latching mechanism comprising latches extending from the lower end of the body that fit within grooves in the refill container, wherein release of the latches from the grooves allows the body and refill container to be rotated with respect to one another.

2. The refillable packaging container of claim 1, wherein the lower end of the body and a lower end of the detachable refill container are threadedly attached when the refill container is retained within the body.

3. The refillable packaging container of claim 1, wherein the upper end of the body and upper end of the refill container threadedly attached when the refill container is retained within the body.

4. The refillable packaging container of claim 1, wherein the body further comprises a detachable rear cap that is screwed to the lower end of the body, thereby fully encompassing the refill container.

5. The refillable packaging container of claim 4, wherein the refill container is locked within the body and the rear cap.

6. The refillable packaging container of claim 1, wherein the body and lid are each formed from at least one selected from the group consisting of polyethylene, polypropylene, acrylonitrile butadiene (ABS), polycarbonate (PC), polyamide (PA), and combinations thereof.

7. The refillable packaging container of claim 1, wherein the refill container is formed from at least one selected from the group consisting of polyethylene, polypropylene, polyethylene terephthalate, and combinations thereof.

8. The refillable packaging container of claim 1, wherein the spherical roller ball is formed from polyethylene or polypropylene.

9. The refillable packaging container of claim 6, wherein the polyethylene is a high-density polyethylene.

10. The refillable packaging container of claim 1, wherein the body, the spherical roller ball, the refill container, and the lid are formed from polypropylene.

11. The refillable packaging container of claim 1, wherein the body, the spherical roller ball, the refill container, and the lid are formed from polyethylene.

12. The refillable packaging container of claim 1, wherein the body comprises piercing elements.

13. The refillable packaging container of claim 1, wherein the refill container comprises a concavity on a lower surface thereof.

14. The refillable packaging container of claim 1, wherein the roll-on material is a deodorant, a body lotion, a body fragrance, or a sunscreen.

15. A method of forming a packaging container, comprising:

inserting a refill container configured to contain a roll-on material into a body having a cup at its upper end, a first connection below the cup, and an opening at its lower end, wherein the cup retains a spherical roller ball; and retaining the refill container with the body to form the packaging container of claim 1.

16. The method of claim 15, further comprising replacing the refill container with a new refill container.

17. The method of claim 16, wherein the new refill container has a different volume than the refill container.

18. The method of claim 15, further comprising: refilling the refill container with the roll-on material prior to the inserting.

19. The method of claim 15, further comprising forming the body by injection molding.

20. The method of claim 15, further comprising forming the lid by injection molding or thermoforming.

21. The method of claim 15, further comprising forming the refill container by injection molding or blow molding.

22. The method of claim 15, further comprising forming the spherical roller ball by injection molding.

* * * * *